United States Patent [19]

King, deceased et al.

[11] 4,313,632

[45] Feb. 2, 1982

[54] GOLF BALL RETRIEVER

[76] Inventors: Gilbert T. King, deceased, late of Utica, Mich.; Gilbert D. King, administrator, 45810 Cass Ave., Utica, Mich. 48087

[21] Appl. No.: 112,875

[22] Filed: Jan. 17, 1980

[51] Int. Cl.[3] ..... A63B 47/02

[52] U.S. Cl. ..... 294/19 A; 294/24

[58] Field of Search ..... 294/19 R, 19 A, 20, 294/22, 23, 24, 33, 55, 99 R; 273/32 F, 162 E

[56] References Cited

U.S. PATENT DOCUMENTS

| | | | |
|---|---|---|---|
| 1,658,145 | 2/1928 | Uyei | 294/19 A |
| 1,715,039 | 5/1929 | Locke et al. | 294/99 R |
| 2,738,214 | 3/1956 | Zimmers | 294/19 A |
| 3,265,430 | 8/1966 | Jenkins | 294/19 A |
| 3,434,753 | 3/1969 | DeCroes | 294/19 A |
| 4,077,659 | 3/1978 | Sievers | 294/19 A |

FOREIGN PATENT DOCUMENTS

| | | | |
|---|---|---|---|
| 1501997 | 11/1967 | France | 294/19 A |

*Primary Examiner*—Johnny D. Cherry

*Attorney, Agent, or Firm*—Krass, Young & Schivley

[57] ABSTRACT

A ball retriever for retrieving a golf ball from water hazards with various bottom conditions. The device is molded in one piece to offer either a gripping action or a scooping action. Fingers are provided for gripping a golf ball that lies in a water hazard having a firm bottom. Prongs are provided for scooping a golf ball that lies in a water hazard having a soft bottom.

9 Claims, 5 Drawing Figures

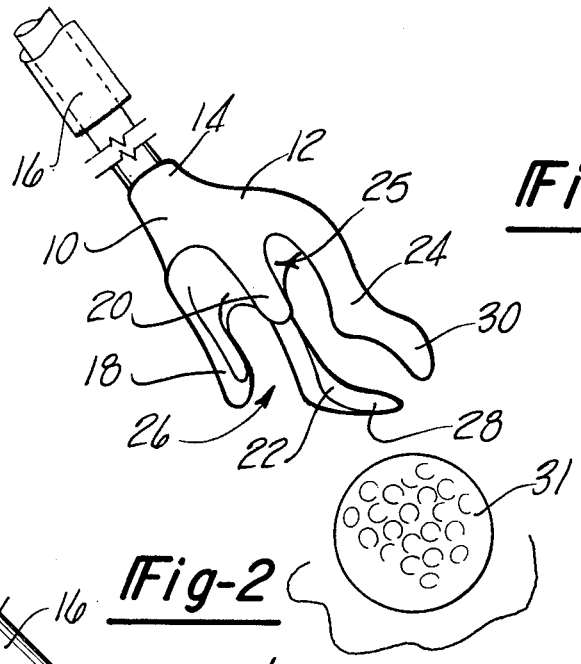
Fig-1
Fig-2
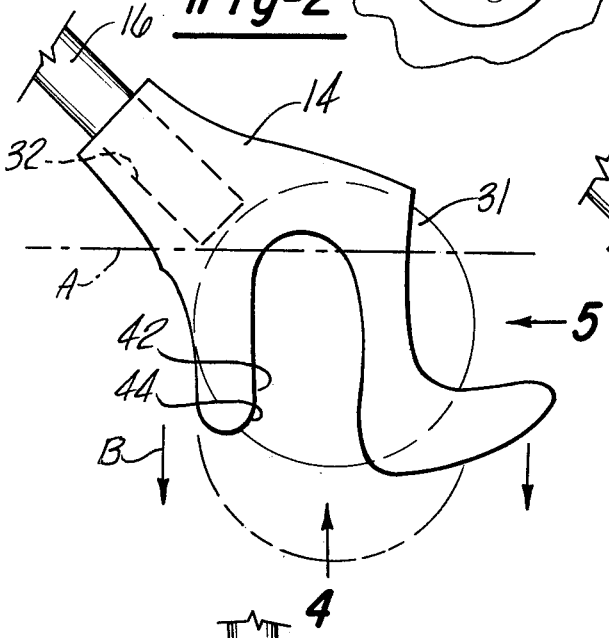
Fig-3
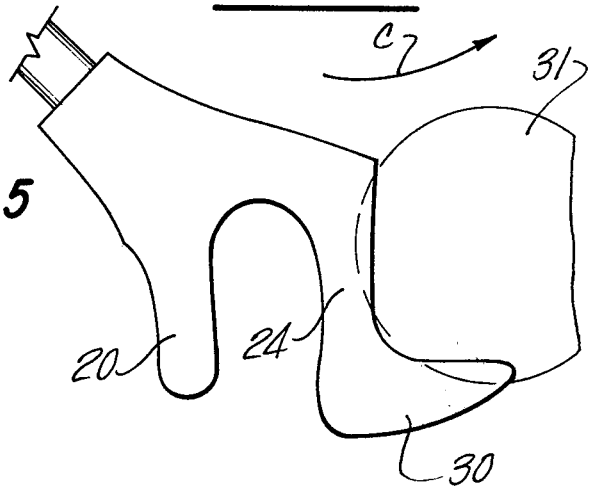
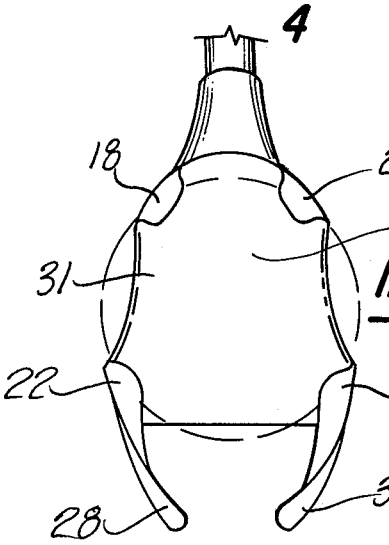
Fig-4
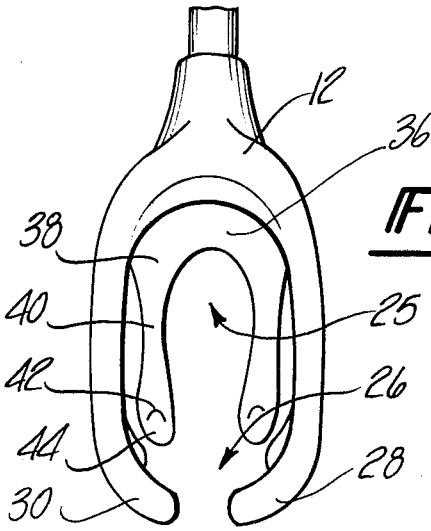
Fig-5

GOLF BALL RETRIEVER

TECHNICAL FIELD

This invention relates generally to ball retrievers, and more particularly to a golf ball retriever having a one piece plastic body.

BACKGROUND ART

There are many devices which have been proposed to retrieve golf balls from inaccessible places such as water hazards.

U.S. Pat. No. 1,658,145 to Uyei issued Feb. 7, 1928 discloses a shaft mounted device with resilient gripping fingers projecting from one end of the shaft. This device is limited to retrieving golf balls that lie on the ground close to the operator.

U.S. Pat. No. 3,265,430 to Jenkins issued Aug. 9, 1966 discloses a device having an inverted pocket that may be forced over a golf ball. Considerable downward pressure must be exerted to wedge a ball within the device. A golf ball is engaged within the device by pressing it against the ball as it lies on the bottom of a water hazard. If a lake has heavy silt deposits, the bottom may be too soft to provide sufficient resistance for the device to grip the golf ball. When this occurs the ball may become mired under the silt deposits.

U.S. Pat. No. 3,442,544 to Faber issued May 6, 1969 describes an improved cup shaped retriever with a spring retainer. The spring retainer reduces the amount of pressure required to engage a golf ball within the device. The spring tension is critical for efficient operation; if it is too tight excessive pressure is required, if it is loose the ball may be dislodged when it is lifted out of the water. This device is heavy, expensive to manufacture and unwieldy.

Other prior art devices are designed for scooping a ball from the bottom of a lake. An example of this type is a simple loop attached to the end of a shaft. To retrieve a golf ball the loop is maneuvered under the ball so that the ball may be lifted. However, if the bottom is hard it is difficult to get the device under the golf ball.

The present invention is directed to overcoming the problems as set forth above.

DISCLOSURE OF THE INVENTION

The problem to which this invention is directed is efficiently retrieving golf balls from water hazards which have either a hard or a soft bottom. To solve this problem a dual function retriever is disclosed that can retrieve by either a gripping or a scooping/prying action. The gripping action is provided by elastically deformable fingers molded in a one piece construction that is lightweight, simple to manufacture and easy to use. The scooping/prying action is provided by integrally molding in the same one piece construction a forwardly projecting prong on each of the anterior fingers. The scooping function allows a golf ball to be retrieved without relying on the lake bottom for support. This has the advantage of increased effectiveness in that a ball may be lifted from a soft lake bottom without taking a chance of forcing the ball under the surface. This dual function device is provided without impairing either function or adding unnecessary weight or complexity to the device.

BRIEF DESCRIPTION OF THE DRAWINGS

FIG. 1 is a perspective view of a preferred embodiment of the device poised above a golf ball.

FIG. 2 is a side view of a preferred embodiment of the device with a golf ball gripped by the fingers.

FIG. 3 is a side view of a preferred embodiment of the device with a golf ball resting between the forwardly projecting prongs.

FIG. 4 is a bottom view taken from vantage point 4 in FIG. 2 showing the gripping means.

FIG. 5 is an elevation view taken from vantage point 5 in FIG. 2 showing the alignment of the fingers.

BEST MODE FOR CARRYING OUT THE INVENTION

Referring to the drawings, in FIG. 1 the golf ball retriever is shown to comprise a body 10 made of substantially rigid elastically deformable material. The body has a top portion 12 that incorporates a shaft retaining means 14 into which is fitted a shaft 16 that extends from the body to serve as a handle for the device. The shaft is conventional and will not be described in detail. Depending from the top portion are first and second posterior fingers 18 and 20 and first and second anterior fingers 22 and 24 which form a pocket 25. The anterior and posterior fingers are inwardly curved and terminate at approximately the same distance from the top portion to define an approach opening 26 through which a golf ball may pass. The anterior fingers 22 and 24 have first and second prongs 28 and 30 respectively, projecting forwardly and inwardly to provide a scooping and prying means for lifting a golf ball 31 from mud, silt or sand.

Describing the device in greater detail, the body 10 is injection molded in one piece from a thermoplastic resin. As shown in FIG. 2, shaft retaining means 14 comprises an integrally molded neck having a central bore 32 approximately 0.75 inches in depth and having a diameter equal to the diameter of the shaft 16. The axis of the bore is set at an angle of between 30° and 45° from horizontal plane A. One end of the shaft is bonded within the bore 32 thereby permanently mounting the device on the shaft. As shown in FIG. 1, the shaft 16 may be of the telescopic, extensible type well known in the art.

As shown in FIG. 5, the pocket 25 is formed by a concave surface 36 on the lower surface of the top portion 12 and by the anterior and posterior fingers depending therefrom. The pocket has an approach opening 26 defined by the ends of the fingers opposite the top portion. Opening 26 has a diameter less than the diameter of a golf ball, but is expandable to allow a golf ball to pass therethrough. The diameter of the pocket is just slightly larger than the diameter of a golf ball so that after a ball passes through opening 26 and is fully inserted in the pocket, as shown in FIG. 4, the fingers 18, 20, 22, 24 contract to hold the golf ball in the pocket.

As shown in FIG. 5, each finger has four portions that function to provide said gripping action. The four portions are an initial portion 38, a flexible portion 40, a lobe portion 42 and a guide portion 44. The initial portion 38 is approximately $\frac{1}{8}''$ thick and extends from the concave surface 36. The flexible portion 40 is approximately 1/16" thick to allow the finger to yield outwardly as the golf ball passes the lobe portion 42. The lobe portion is approximately $\frac{1}{8}''$ thick and acts as a retaining means to hold the golf ball after it has passed into the pocket. The guide portion 44 is a convex surface disposed at the end of each respective finger to define a lead angle which serves to guide said golf ball into the pocket.

As shown in FIGS. 4 and 5, first and second prongs 28 and 30 project from the front of lobe portion 42 and guide portion 44 of anterior fingers 22 and 24 respectively. The prongs curve toward each other so as to partially encircle the bottom of a golf ball for support in lifting. As shown in FIG. 3, the scooping means is provided by the anterior fingers acting as back ups on either side with the prongs cradling the lower portion of the golf ball. It should be noted that the two prongs may be joined to form a single loop that could provide an equivalent scooping function without departing from the spirit of the invention.

INDUSTRIAL APPLICABILITY

The golf ball retriever as described herein offers both gripping and scooping retrieving actions. To grip a golf ball the retriever is first positioned above the ball, then the retriever is moved in direction "B" as shown in FIG. 2. The guide portion 44 of each finger acts to align the golf ball with the opening 26. As the motion continues, an outward force is exerted on the lobe portion 42 of each finger. This force causes the lobe portion of each finger to move in an outward direction which is facilitated by the yielding of the flexible portion 40 to allow the golf ball to pass the now expanded opening. The golf ball is secured within the pocket 25 by the fingers returning to the unexpanded condition. After the ball has been removed from the water hazard the golf ball may be removed from the pocket by forcing the ball back thru the orifice.

To scoop a golf ball the retriever is positioned with the first and second prongs 28 and 30 below and projecting toward the golf ball. The retriever is then moved in an upward arc as shown by the directional arrow C in FIG. 3. The golf ball is guided by the prongs to a position between the first and second anterior fingers 22 and 24 and resting on the prongs. Once the golf ball is in this position it may be lifted from the water hazard and carried to the shore.

The dual function golf ball retriever thus disclosed provides an inexpensive, single piece device that allows a choice for the most efficient method for retrieving golf balls. The positive control gripping action may be used if the bottom is firm. However, if there is a risk of losing the ball under a soft bottom the scoop retrieval method may be used. Other aspects, objects and advantages of this invention can be obtained from a study of the drawings, the disclosure and the appended claims.

What is claimed is:

1. A golf ball retriever comprising a shaft, a body made in one piece of substantially rigid elastically deformable material having a top portion including a shaft retaining means, a pair of posterior fingers and a pair of anterior fingers depending in spaced relationship from the top portion to form a pocket having a concave inner surface, said fingers terminating in spaced relationship defining an opening slightly smaller in diameter than a golf ball, a prong extending substantially horizonally from the lower portion of each anterior finger and away from said shaft defining a scoop means having a width smaller than the diameter of a golf ball, whereby a golf ball may be retained temporarily for transportation by being either forced through the opening and gripped in the pocket defined by the anterior and posterior fingers, or lodged between the prongs.

2. A golf ball retriever as described in claim 1 wherein said body is attached to an extensible shaft.

3. A golf ball retriever as described in claim 1 wherein said body is made of plastic.

4. A golf ball retriever as described in claim 1 wherein said pocket has an inner surface designed to follow the contour of a golf ball.

5. A golf ball retriever as described in claim 4 wherein the anterior and posterior fingers are shaped with an inwardly curved inner surface.

6. A golf ball retriever as described in claim 1 wherein said prongs project forwardly and curve toward each other to partially encircle the bottom of a golf ball.

7. A golf ball retriever as described in claim 1 wherein two posterior fingers depend from said top portion.

8. An improved golf ball retriever of the type including a one piece body formed of elastically deformable material, means for retaining a shaft formed integrally with said body, a plurality of spaced fingers attached on one end to the concave lower portion of said body, each of said fingers having lobes adjacent a terminal end, said body and fingers defining a pocket for enveloping at least a portion of a golf ball to positively grip said golf ball, wherein the improvement comprises:

scoop means attached to the lower portion of said fingers for supporting lower portions of said golf ball and being adapted to lift said golf ball, said scoop means extending away from said fingers and defining a scooping pocket spaced from said gripping pocket.

9. A golf ball retriever as described in claim 8 wherein said gripping pocket has an opening and said scooping pocket has an oppositely oriented opening.

* * * * *